US009186554B2

(12) United States Patent
Lord et al.

(10) Patent No.: US 9,186,554 B2
(45) Date of Patent: Nov. 17, 2015

(54) SWIM FIN FOR LEG AMPUTEES

(71) Applicants: Randall Wade Lord, Danforth, ME (US); Lori Elizabeth Lord, Danforth, ME (US)

(72) Inventors: Randall Wade Lord, Danforth, ME (US); Lori Elizabeth Lord, Danforth, ME (US)

( * ) Notice: Subject to any disclaimer, the term of this patent is extended or adjusted under 35 U.S.C. 154(b) by 0 days.

(21) Appl. No.: 14/175,304

(22) Filed: Feb. 7, 2014

(65) Prior Publication Data

US 2015/0079861 A1 Mar. 19, 2015

Related U.S. Application Data

(60) Provisional application No. 61/877,809, filed on Sep. 13, 2013.

(51) Int. Cl.
*A63B 31/08* (2006.01)
*A63B 31/12* (2006.01)
*A63B 71/00* (2006.01)

(52) U.S. Cl.
CPC ..... *A63B 31/12* (2013.01); *A63B 71/0009* (2013.01)

(58) Field of Classification Search
USPC ..... 441/64
IPC ..... A63B 31/11,2031/117, 3031/117, 31/12, A63B 71/0009
See application file for complete search history.

(56) References Cited

U.S. PATENT DOCUMENTS 3,109,186 A 11/1963 Glenn
3,913,158 A 10/1975 Vilarrubis
3,952,351 A 4/1976 Gisbert
3,978,537 A 9/1976 Shamlian
4,250,584 A 2/1981 Korn
4,300,255 A 11/1981 Beuchat
4,657,515 A 4/1987 Ciccotelli
4,689,029 A 8/1987 Ciccotelli
4,752,259 A 6/1988 Tackett et al.
4,787,871 A 11/1988 Tomlinson
4,867,441 A 9/1989 Blakeman
4,929,206 A 5/1990 Evans
4,934,971 A 6/1990 Picken
4,952,183 A 8/1990 Gil (Continued)

FOREIGN PATENT DOCUMENTS

DE 1808808 3/1960

OTHER PUBLICATIONS

Notification of International Search Report and Written Opinion in PCT application No. PCT/US2014/046276 dated Nov. 4, 2014, 8 pp.

(Continued)

*Primary Examiner* — Stephen Avila
(74) *Attorney, Agent, or Firm* — Caseiro Burke LLC; Chris A. Caseiro

(57) ABSTRACT

A modified swim fin comprising a swim fin component and a leg amputation coupling. The swim fin component and the amputation coupling may be two separate structures joined together such as by welding, glue, mechanical attachment or integral fabrication. The coupling may be formed of two elements, a prosthetic soft, shell and an encasing non-metallic material such as a plastic or rubber. The prosthetic soft shell forms the interior of the coupling for direct contact with the amputated leg. The fin component and the coupling are fixedly joined together so that they do not pivot at their interface. Their centerlines are substantially aligned to minimize pain and/or injury for the wearer and to maximize performance.

5 Claims, 2 Drawing Sheets

(56) References Cited

U.S. PATENT DOCUMENTS

| | | | | |
|---|---|---|---|---|
| 5,139,450 | A * | 8/1992 | Steele | 441/64 |
| 5,242,321 | A | 9/1993 | Gil | |
| 5,259,798 | A | 11/1993 | Runckel | |
| 5,266,062 | A | 11/1993 | Runckel | |
| 5,511,999 | A | 4/1996 | Cochran et al. | |
| 5,597,336 | A | 1/1997 | Evans | |
| 5,632,662 | A | 5/1997 | Cadorette | |
| 5,702,277 | A * | 12/1997 | Wagner | 441/64 |
| 5,868,592 | A | 2/1999 | Bulin et al. | |
| 5,906,525 | A | 5/1999 | Melius et al. | |
| 6,193,636 | B1 | 2/2001 | Chen | |
| 6,341,993 | B1 | 1/2002 | Lalli, Jr. | |
| 6,346,021 | B1 | 2/2002 | Masse | |
| 6,375,530 | B1 | 4/2002 | Earl | |
| 6,561,862 | B1 | 5/2003 | Moore | |
| 6,620,008 | B2 | 9/2003 | Green | |
| 6,749,472 | B1 | 6/2004 | Chen-Lieh | |
| 6,814,640 | B1 | 11/2004 | Houck | |
| 6,893,307 | B1 | 5/2005 | Melius | |
| 6,979,241 | B2 | 12/2005 | Hull | |
| 8,246,404 | B1 | 8/2012 | Sweet | |
| 8,251,764 | B2 | 8/2012 | Hsu | |
| 2005/0118904 | A1 | 6/2005 | Belloni | |
| 2009/0325434 | A1 | 12/2009 | Mun et al. | |
| 2010/0075554 | A1 | 3/2010 | Johnson | |
| 2011/0312231 | A1 | 12/2011 | Montemurro | |
| 2012/0252289 | A1 | 10/2012 | Johnson | |
| 2013/0090028 | A1 | 4/2013 | Mayer | |
| 2013/0217281 | A1 * | 8/2013 | Gadler | 441/115 |

OTHER PUBLICATIONS

Rippetoe, K. Design of a Prosthetic Swimming Leg. One With the Water. May 3, 2013. [retrieved on Oct. 8, 2014]. Retrieved from the Internet. ,URL: http//onewiththewater.org/design-prosthetic-swimming-leg/>. entire document, 8 pp.

Burns, C. Clip-on Fin to Turn to Aquaman. Yanko Design. Jun. 22, 2010. [retrieved on Oct. 9, 2014]. Retrieved from the Internet. <URL:http://www.yankodesign.com/2010/06/22/clip-on-fin-to-turn-to-aquaman/>. entire document,10 pp.

Prosthetics Photos—Custom Swim Leg. Orthotic & Prosthetic Centers. Jan. 29, 2013. [retrieved on Oct. 9, 2014]. Retrieved from the Internet. <URL: http://www.op-centers.com/prosthetic/prosthetic-photos/22-custom-swim-leg-prosthesis>. entire document, 2 pp.

* cited by examiner

SWIM FIN FOR LEG AMPUTEES

CROSS REFERENCE TO RELATED APPLICATION

The present invention is a nonprovisional application, and claims the priority benefit, of provisional U.S. patent application Ser. No. 61/877,809, filed Sep. 13, 2013, entitled SWIM FIN FOR LEG AMPUTEES of the same named inventors. The entire contents of that priority application are incorporated herein by reference.

BACKGROUND OF THE INVENTION

1. Field of the Invention

The present invention relates to swim fins. More particularly, the present invention relates to swim fins suitable for use by above-the-knee and below-the-knee leg amputees. The present invention is a swim fin with an adapter configured to engage with an amputated leg.

2. Description of the Prior Art

Individuals with an amputated leg or amputated legs have been unable to swim. Any effort, to do so with a prosthetic leg is met with great difficulty. A prosthetic leg is heavy and great exertion is required to move it in water. It can too easily become disengaged from the amputated leg. The prosthetic can be ruined by immersion. In fresh water or sea water. Devices have been created to modify common swim fins for removable attachment to a prosthetic leg for the purpose of aiding a leg amputee. Such modified swim tins at best only provide propulsion in one direction of leg motion, if at all. The result is that the wearer must be in tremendous physical condition to move the amputated leg effectively. Further, the interface between such a modified swim fin and the prosthetic can cause substantial pain to the wearer. All such attempts appear to have a hinged arrangement at the interface between the swim fin and the part adapted to connect to a prosthetic. That hinge is a pressure point for the wearer, which causes pain. It also limits the ability to generate propulsion as water is only moved on the down stroke of the leg and not on the up stroke. In addition, currently known attempts to accommodate amputees provide swim fins with straps. The straps are not satisfactory because, as the leg shrinks in cold water, the strap is less effective and must be adjusted constantly. The resultant loosening causes sores as well as chafing and pressure points. In effect, there is currently no effective device configured to enable a leg amputee to swim with the same exertion and lack of pain as experienced by non-amputees.

What is needed is a modified swim fin suitable for use by leg amputees. Such a modified swim fin must be effectively adaptable to a leg amputee's particular condition so that pain during use is minimized. Further, what is needed is such a modified swim tin that the wearer can use without causing damage to a prosthetic or without a prosthetic at all. Yet further, what is needed is a modified swim fin that can be used by a leg amputee for effective propulsion through the water without, excessive physical exertion required.

SUMMARY OF THE INVENTION

It is an object of the present invention to provide a modified swim fin suitable for use by leg amputees. The modified swim fin must be effectively adaptable to a leg amputee's particular condition so that pain during use is minimized. In addition, it is an object of the invention to provide a modified swim fin that the wearer can use without causing damage to a prosthetic or without wearing a prosthetic at all. It is also an object of the invention to provide a modified swim tin that can be used by a leg amputee for effective propulsion through the water without excessive physical exertion required.

These and other objects are achieved with the present invention, which is a modified swim fin comprising a swim fin component and a leg amputation coupling. A cover, such as a sleeve or a portion of a wetsuit, is placed over the interlace between the swim fin and the coupling. The swim fin component and the amputation coupling may be formed as a single integral structure such as by molding it as a single non-metallic material, such as rubber or plastic, for example. Alternatively, the swim fin component and the amputation coupling may be two separate structures joined together such as by welding, glue or mechanical attachment. The coupling may be formed of two elements, a prosthetic soft shell and an encasing non-metallic material such as a plastic or rubber. The prosthetic soft shell forms the interior of the coupling for direct contact with the amputated leg. The cover may be a sleeve of non-metallic materials, such as rubber, for example, having some stretchability. If used, it should be thin enough to ensure that the strike modified fin remains substantially hydrodynamic when in use. As noted, a portion of a wetsuit may be used for that function.

The coupling is configured to ensure a comfortable fit to the amputated leg over an extended period of time and during the movement of the leg that causes propulsion. The interface between the swim fin and the coupling is fixed rather than hinged so that there is no pressure point at that location, which pressure point can cause pain for the wearer. The fixed interface fort her improves propulsion capability for the wearer in that water movement is generated on the up stroke as well as the down stroke. That is, a porpoising effect is enabled by the present invention.

These and other advantages of the present invention will be more fully understood upon review of the following detailed description, the accompanying drawings and the appended claims.

DETAILED DESCRIPTION OF THE PREFERRED EMBODIMENT OF THE INVENTION

Figure 1:
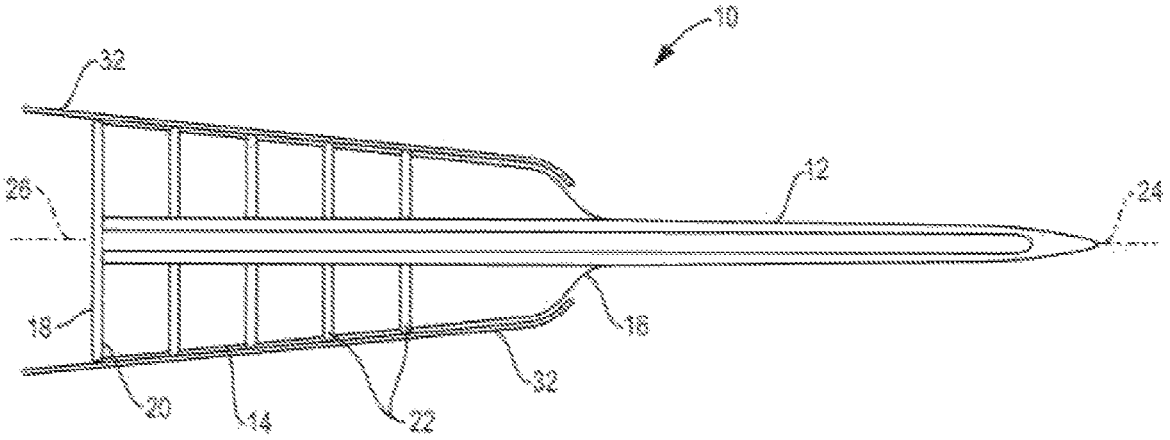
FIG. 1 is a side view of the modified swim fin of the present invention.
Figure 2:
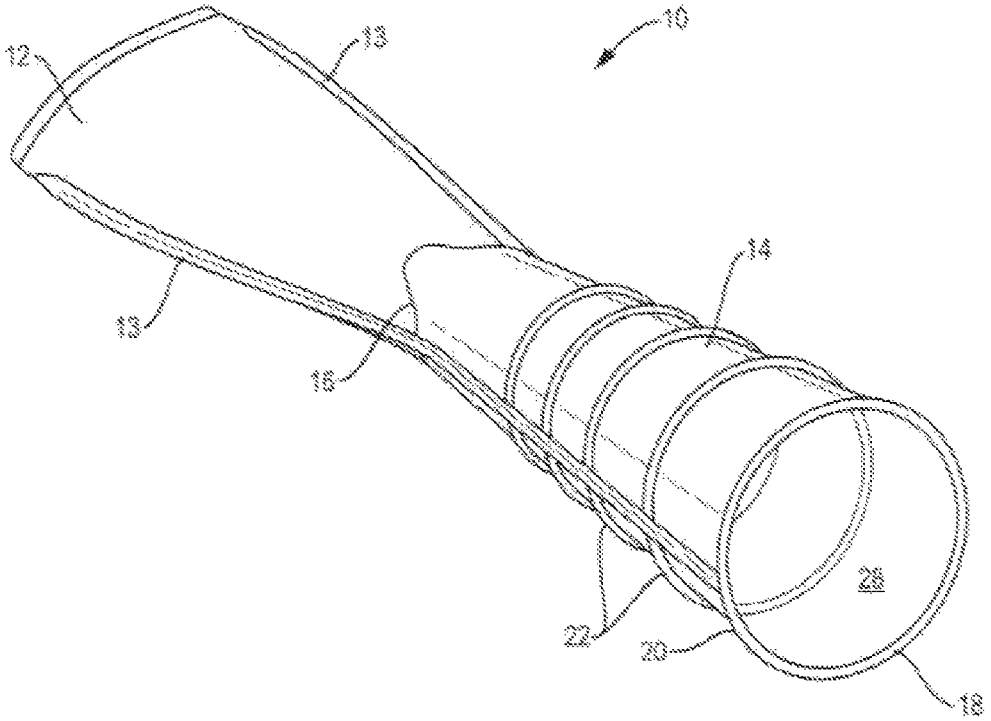
FIG. 2 is a rear perspective view of the modified swim fin of the present invention.
Figure 3:
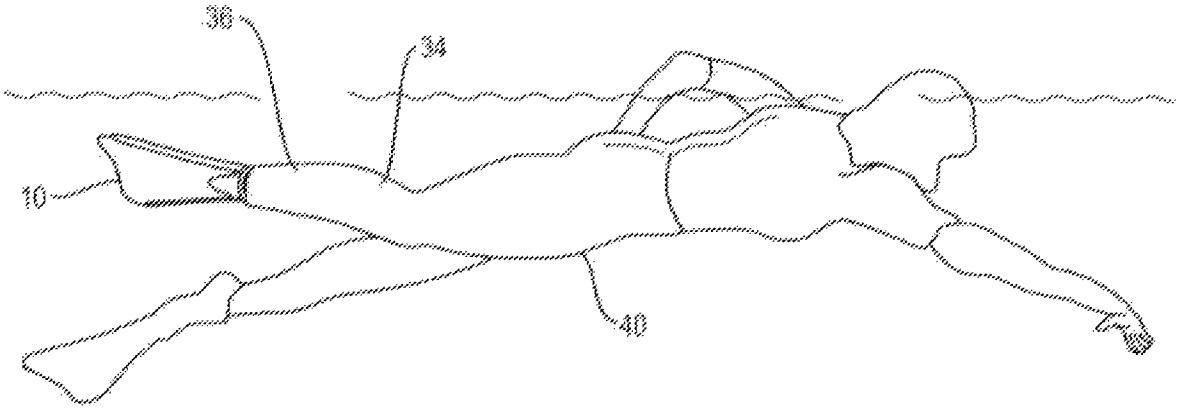
FIG. 3 is a side view of a leg amputee wearing a modified swim fin of the present invention, showing die invention on a shorter amputated leg.

A modified swim fin 10 of the present invention is shows in FIGS. 1-3. The modified swim fin 10 includes a fin component 12 and a leg amputation coupling 14. The fin component 12 and the coupling 14 are joined together at interface 16. It can be seen that the interface 16 is fixed; that is, it is rigid so that there is no pivoting of the fin component 12 when the amputated leg moves upwardly and downwardly, such as at the knee and/or the hip. This enables propulsion on the up stroke and the down stroke of the leg.

The fin component 12 may be fixed to the coupling 14 by welding the two together, by gluing them together or by mechanically joining them together, such as with corrosion resistant screws. Alternatively, the fin component 12 and the coupling 14 may be fabricated together as a unitary structure. The fin component 12 and the coupling may be made of the same material or a different material. That material may be a non-metallic material such as a rubber or a plastic. The fin component 12 may be configured similar to conventional swim fins with dimensions that can vary. It does not extend all the way into the coupling 14 but terminates at the interface 16. It may be profiled to maximize its hydrodynamic effect. The coupling 14 is formed of two elements, an interior prosthetic soft shell 18 and a more rigid outer shell 20. The outer shell 20 is joined to the fin component 12 at the interlace 16 or is at least a unitary structure with a transition at the interface 16.

The interior soil shell 18 is fixed to an interior of the outer shell 20, which may have been fabricated separately or with the fin component 12 prior or subsequent to making the soft shell 18. The outer shell 20 may be fabricated of a cured viscoelastic material, such as rubber, for example, using the same material to form the tin component 12. It may include ribbing 22 to ensure retention thereto of an outer cover described herein while minimizing the weight of the modified swim fin 10, providing more flexibility for the wearer and reducing chances of injury, chafing and/or pain.

The soft shell 18 should be made from a mold of the amputee's leg, although it is contemplated that some versions of the modified fin 10 may be formed with standardized soft shells in a range of dimensions and with sufficient flexibility to conform to the amputated leg. In general, the sod shell 18 will likely be made by a licensed prosthetic technician. The soft, shell 18 may be placed in a prefabricated outer shell 20 or the outer shell 20 may be formed about the soft shell 20 and allowed to cure or harden. Alternatively, the outer shell 20 may be formed separately and cut to fit and bonded around the soft shell 18. The fin component 12 may be located adjacent to the soft shell 18 in that instance and the outer shell 20 formed about the soft shell 18 and the tin component 12 at the interface 16. The soft shell 18 may also be custom formed to the amputee's particular leg dimensions. For example, a mold of the leg may be made using knows materials such as NickelPlast™ liners available from AliMed, Inc., of Dedham, Mass., Keasy® cone available from Cascade Orthopedic Supply, Inc., of Chico, Calif., or other suitable materials. Once the mold has been completed, the soft shell 18 may be made in the mold. For example, the soft shell 18 may be fabricated of a polymeric foam, such as a polyurethane foam for example.

The modified swim fin 10 may be fabricated so that the fin component 12 is not aligned with the coupling 14. However, the modified swim fin 10 is preferably fabricated so that a centerline 24 of the fin component 12 is substantially aligned with a centerline 26 of the coupling 14. This alignment maximizes propulsion efficiency and limits the creation of one or more pressure points at the interface 16. Those two effects improve the experience for the user by minimizing required exertion and reducing the chance of pain caused by that exertion. Further, upper and lower portions of the fin component 12 may have the same profile for even water displacement. As shown in FIG. 2, the fin component 12 may have reinforcing ribs 13 on each side and optionally running to the coupling 14 to provide improved structural support for the wearer.

The modified swim fin 10 of the present invention is configured to be placed on an amputated leg in substantially the same way that a walking prosthetic is applied. That is, the coupling 14 forms an opening 28 into which the amputated leg is inserted. The fit between the leg and the interior of the soft shell 18 may be sufficiently tight to establish a friction fit and substantially reduce the possibility that the modified fin 10 will become displaced from the leg when in use.

The modified swim fin 10 may include a removable cover or sleeve 32, which may be removably placed about, the interface of the amputated leg and the coupling 14 to enhance a tight connection of the swim fin 10 to the wearer. It can also enhance the hydrodynamic nature of the modified swim fin 10. In one embodiment of the invention, the sleeve 32 is a unitary component. In use, it can be rolled down over the ribbing 22 before the wearer inserts the leg in opening 28. After that placement occurs, the sleeve 32 is rolled onto the wearer's leg to hold the swim fin 10 tightly in place, in another embodiment, the sleeve 32 may be part of a wetsuit 34, such as shown in FIG. 3, wherein a lower portion 36 of the wetsuit 34 on amputated leg 40 may be used as the sleeve 32 and may act as a means to secure the modified swim fin 10 to the amputee's leg 40, in addition to providing a hydrodynamic characteristic for the modified swim fin 10. Specifically in use, the wet suit 34 is first put on and the wet suit leg rolled up the leg. The exposed leg is then inserted into the opening 28 of the modified swim fin 10 and the rolled wet suit leg rolled down over the ribbing 22. By using either form of the sleeve 32, the wearer has a swim fin that feels like a natural extension of the leg with no pressure points.

The modified swim fin 10 of the present invention is particularly well suited for use by amputees with above-the-knee and below-the-knee amputations. It enables recreational therapeutic and exercise activities in the water for amputees. The modified swim fin 10 is effectively adaptable to a leg amputee's particular condition so that pain during use is minimized. If can be used without the need to include a prosthetic. It is configured to enable propulsion on the up stroke and the down stroke. It thereby maximizes movement with efficient exertion.

The present invention has been described with respect to particular components and the ways that they are joined together. Nevertheless, it is to be understood that various modifications may be made without departing from the spirit and scope of the invention. All equivalents are deemed to fall within the scope of this description of the invention.

What is claimed is:

1. A swim fin comprising:

a. a fin component having a centerline; and b. a strapless leg amputation coupling attached to the fin component, the leg amputation coupling having a centerline and an opening into which an amputated leg may be removably inserted, wherein the centerline of the fin component and the centerline of the leg amputation coupling are substantially aligned with one another, wherein the coupling is formed of an inner prosthetic shell and an outer shell that is more rigid than the prosthetic shell, wherein the inner prosthetic shell is configured to fit an individual, and wherein the outer shell is joined to the fin component at, an interface that is fixed so that the coupling and fin component do not pivot with respect to one another to minimize irritation or pain to an amputee when using the swim fin.

2. The device of claim 1, wherein the outer shell and the fin component are formed integrally together.

3. The device of claim 1, further comprising a sleeve removably placeable over at least a portion of the leg amputation coupling.

4. The device of claim 3, wherein the sleeve forms part of a wetsuit.

5. The device of claim 1, wherein the leg amputation coupling is formed with ribs.

* * * * *